US011654321B2

(12) United States Patent
Jay

(10) Patent No.: US 11,654,321 B2
(45) Date of Patent: May 23, 2023

(54) SERPENTINE CLIMBING CORD EXERCISE CLIMBER

(71) Applicant: Jeffrey T. Jay, Las Vegas, NV (US)

(72) Inventor: Jeffrey T. Jay, Las Vegas, NV (US)

( * ) Notice: Subject to any disclaimer, the term of this patent is extended or adjusted under 35 U.S.C. 154(b) by 0 days.

(21) Appl. No.: 17/560,986

(22) Filed: Dec. 23, 2021

(65) Prior Publication Data

US 2022/0193476 A1 Jun. 23, 2022

Related U.S. Application Data

(60) Provisional application No. 63/130,021, filed on Dec. 23, 2020.

(51) Int. Cl.
*A63B 7/04* (2006.01)

(52) U.S. Cl.
CPC ..... *A63B 7/045* (2013.01)

(58) Field of Classification Search
CPC ..... A63B 7/045; A63B 2210/50; A63B 1/00; A63B 7/04; A63B 2009/002–008; A63B 9/00; A63B 69/0084; A63B 69/206; A61H 3/008
See application file for complete search history.

(56) References Cited

U.S. PATENT DOCUMENTS 4,531,514 A * 7/1985 McDonald ..... A61H 1/0218 606/241
5,123,131 A * 6/1992 Jandrakovic ..... A61G 7/1044 297/DIG. 10
5,139,264 A * 8/1992 Wootten ..... A63B 21/154 473/229

(Continued)

FOREIGN PATENT DOCUMENTS

FR 2420983 A1 * 10/1979
WO WO-03076021 A1 * 9/2003 ..... A63B 21/00069

OTHER PUBLICATIONS

Ropeflex RX2500 Fitness Equipment, online: https://www.ropeflex.com/shop/product/rx2500, accessed Dec. 23, 8 pages, ropeflex.com.

(Continued)

*Primary Examiner* — Nyca T Nguyen
(74) *Attorney, Agent, or Firm* — Behmke Innovation Group LLC; James M. Behmke; Jonathon P. Western

(57) ABSTRACT

According to embodiments of the disclosure, an illustrative serpentine climbing cord exercise climber herein may comprise: a plurality of lateral frame members that are connected at upwardly extending ends with a head plate; a plurality of bottom support members that are each connected at outwardly extending ends to respective downwardly extending ends of the plurality of lateral frame members, wherein inwardly extending ends of the plurality of bottom support members are connected by a central joiner that is substantially aligned along a vertical axis with the head plate; and a pulley system comprising one or more pulleys that are coupled to one of the plurality of lateral frame members, one of the plurality of bottom support members, the head plate, and the central joiner, the pulley system operable to allow a climbing cord to travel along the vertical axis and a path defined by the one or more pulleys.

13 Claims, 15 Drawing Sheets

(56) References Cited

U.S. PATENT DOCUMENTS

| | | | | |
|---|---|---|---|---|
| 5,387,186 | A * | 2/1995 | Edland | B66C 5/025 606/241 |
| 7,255,666 | B2 * | 8/2007 | Cardenas | A63B 7/02 482/69 |
| 8,398,530 | B1 * | 3/2013 | Rubens | A63B 23/03533 482/131 |
| 10,532,239 | B1 * | 1/2020 | Suarez Monne | A63B 17/04 |
| 2004/0110607 | A1 * | 6/2004 | Crespo | A63B 69/206 482/89 |
| 2007/0142132 | A1 * | 6/2007 | Bove | A63B 71/06 473/451 |
| 2008/0234109 | A1 * | 9/2008 | Taylor | A63B 22/0056 482/51 |
| 2010/0041520 | A1 * | 2/2010 | Popescu | A63B 23/1209 482/37 |
| 2014/0121063 | A1 * | 5/2014 | Wireman | A63B 71/023 482/23 |
| 2017/0001055 | A1 * | 1/2017 | Brown | A62B 1/14 |
| 2017/0072260 | A1 * | 3/2017 | Jackson | A63B 23/1218 |
| 2019/0160318 | A1 * | 5/2019 | Grenåe | A63B 5/11 |
| 2019/0175972 | A1 * | 6/2019 | Small | A63B 21/157 |
| 2022/0233914 | A1 * | 7/2022 | Birger | A63B 23/0488 |

OTHER PUBLICATIONS

Ropeflex RX2500 Assembly Instructions & Manual, Doc. 32-1016, 32-0016 Rev. B, 2021, 15 pages, ropeflex.com.

* cited by examiner

SERPENTINE CLIMBING CORD EXERCISE CLIMBER

RELATED APPLICATION

This application claims the benefit of U.S. Provisional Application No. 63/130,021, filed on Dec. 23, 2020, entitled SERPENTINE ROPE CLIMBER HAVING COLLAPSIBLE SUPPORT FRAME, by Jeffrey T. Jay, the contents of which are incorporated herein by reference.

TECHNICAL FIELD

The present disclosure relates generally to rope climbers, and, more particularly, to a serpentine climbing cord exercise climber.

BACKGROUND

Rope climbers traditionally feature a rope that is statically hung from a ceiling, typically clamped to a beam and connected using a shackle between two swivels. Known as a "dead hang," obtaining usefulness requires rope length, which correspondingly requires attachment height. Most elementary and high schools no longer permit rope climbing due to the potential for climbers to become injured if they fall. Likewise, adult is climbers encounter fewer opportunities for rope climbing where many workout facilities are in venues with insufficient ceiling height. Such gyms may resort to rope pullers, where the user sits on a bench and pulls a rope that cycles through various adjustable tension-creating devices. However, there is no climbing, either simulated or actual, when using this equipment.

SUMMARY

According to various embodiments herein, a serpentine climbing cord exercise climber that may comprise a collapsible support frame is introduced.

According to one or more specific embodiments of the disclosure, a serpentine climbing cord exercise climber herein may comprise: a plurality of lateral frame members that are connected at upwardly extending ends with a head plate; a plurality of bottom support members that are each connected at outwardly extending ends to respective downwardly extending ends of the plurality of lateral frame members, wherein inwardly extending ends of the plurality of bottom support members are connected by a central joiner that is substantially aligned along a vertical axis with the head plate; and a pulley system comprising one or more pulleys that are coupled to one of the plurality of lateral frame members, one of the plurality of bottom support members, the head plate, and the central joiner, the pulley system operable to allow a climbing cord to travel along the vertical axis and a path defined by the one or more pulleys.

Other embodiments are described below, and this summary is not meant to limit the scope of the present disclosure.

BRIEF DESCRIPTION OF THE DRAWINGS

The embodiments herein may be better understood by referring to the following description in conjunction with the accompanying drawings in which like reference numerals indicate identically or functionally similar elements, of which.

DETAILED DESCRIPTION

The present disclosure introduces a rope climber apparatus, which may from time-to-time be referred to as a serpentine climbing cord exercise climber herein, having a low-height frame utilizing a serpentine climbing cord (e.g., a rope, cable, etc.) received within multiple pulleys. In some embodiments, an adjustable clutch mechanism utilizing a pulley-tensioner allows the rope climber apparatus to accommodate climbers having a diverse range of body sizes and weights. In one embodiment, the frame of the rope climber is collapsible, enabling rapid setting-up, tearing down, and transporting of the climber. It is to be understood that the invention is not limited in its application to the details of construction and the arrangement of components described hereinafter and illustrated in the figures. Those skilled in the art will recognize that various modifications can be made without departing from the scope of the invention.

Figure 1A:
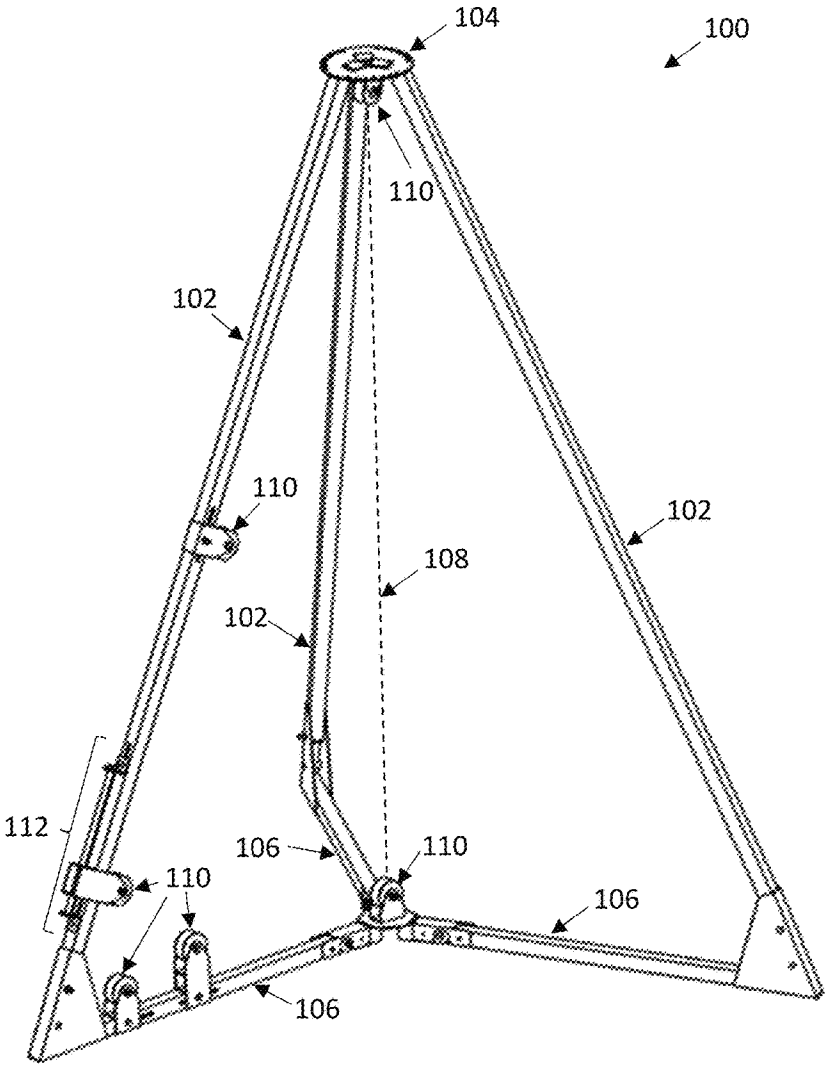
FIGS. 1A-1C illustrate various views of an example serpentine climbing cord exercise climber, without a climbing cord.
Figure 1B:
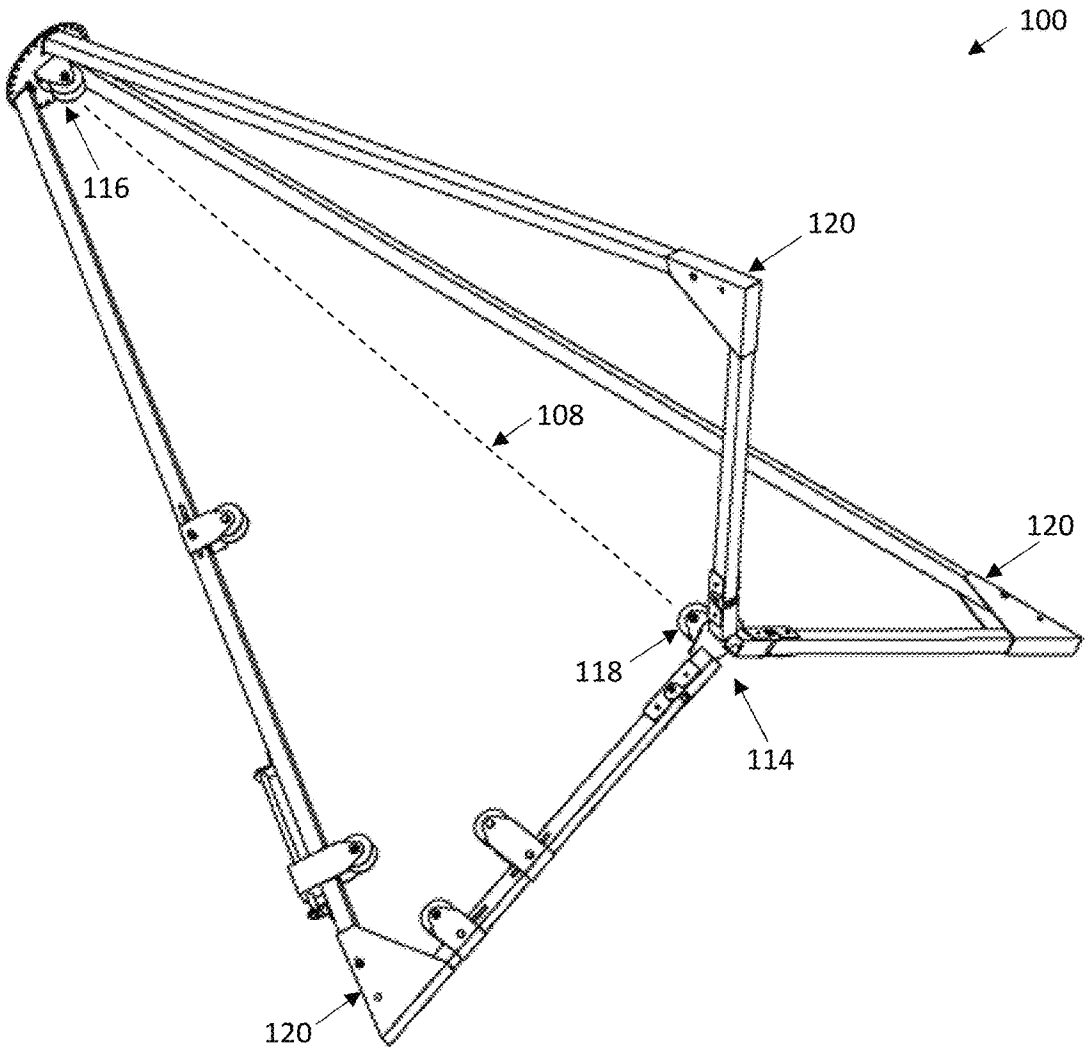
Figure 1C:
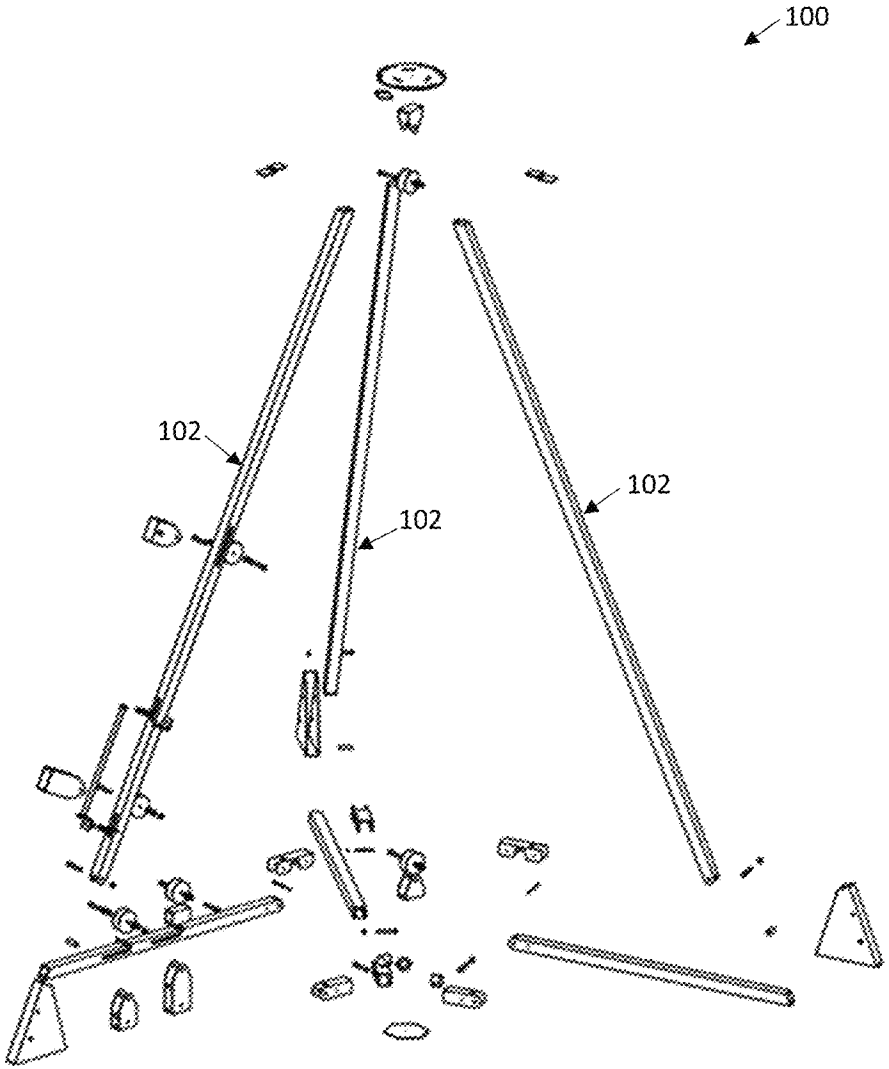

FIGS. 1A-1C illustrate various views of an example serpentine climbing cord exercise climber, without a climbing cord (for clarity), according to various embodiments. FIG. 1A illustrates a frontal view of the example serpentine climbing cord exercise climber 100, which, as shown, is of a substantially pyramidal shape, having a plurality of lateral frame members 102 extending downwardly and outwardly from a central circular head plate 104 (e.g., a circular head plate). A plurality of bottom support members 106 individually connect to respective bottom ends of the lateral frame members 102. Ends of the plurality of bottom support members 106 (that are not connected to lateral frame members 102) may each extend inward, meeting at central vertical axis 108 of the climber. Central vertical axis 108 may be understood as substantially aligned from central circular head plate 104 towards an intersection of bottom support members 106. As will be described in greater detail herein below, a plurality of pulleys 110 may define a path for a serpentine climbing cord (e.g., a rope of various materials), where an adjustable tensioner clutch 112 cooperatively interacts with one or more of the plurality of pulleys 110 so that tension that is applied to the serpentine cord (where the tension may be varied/adjusted as desired, particularly as described below).

Turning to FIG. 1B, a bottom view of the example serpentine climbing cord exercise climber 100 is shown. In particular, a central joiner 114 that is substantially aligned with central vertical axis 108 is shown, where central joiner 114 may join inward ends of bottom support members 106. That is, central joiner 114 may have a locking plate for each of bottom support members. As shown, a first pulley 116 (of the plurality of pulleys 110) at the center of central circular head plate 104 and a second pulley 118 at central joiner 114 may define a vertical length of a serpentine climbing cord that is the is climbing portion of the serpentine climbing cord. Further, FIG. 1B illustrates a plurality of envelope captures 120 that are used to connect bottom ends of lateral frame members 102 to outward ends of bottom support members 106.

Each of bottom support members 106 may comprise a hinged connection to central joiner 114, enabling central joiner 114 to be lifted vertically towards central circular head plate 104 when central joiner 114 is removed from serpentine climbing cord exercise climber 100. Bottom support members 106 follow along and are also lifted up, pivoting substantially at central joiner 114 and at respective outer ends of bottom support members 106 (where they are connected to lateral frame members 102). In a preferred embodiment, connection of the lateral frame members 102 to central circular head plate 104 may utilize an S-shaped hinge, thereby enabling lateral frame members 102 to pivot inwardly at central circular head plate 104. The continued lifting of central joiner 114 results in a folding-inward movement of lateral frame members 102, ultimately resulting in a collapsed configuration of serpentine climbing cord exercise climber 100.

Turning to FIG. 1C, an exploded view of serpentine climbing cord exercise climber 100 is shown. Various components of serpentine climbing cord exercise climber 100 will be discussed with additional detail herein below. While lateral frame members 102 are shown as linear, further embodiments provide for the use of multi-angled lateral frame members, with the upper portion extending outward before its downward extension to connect with the bottom supports, providing greater clearance inside the support frame for the climber.

Figure 2:
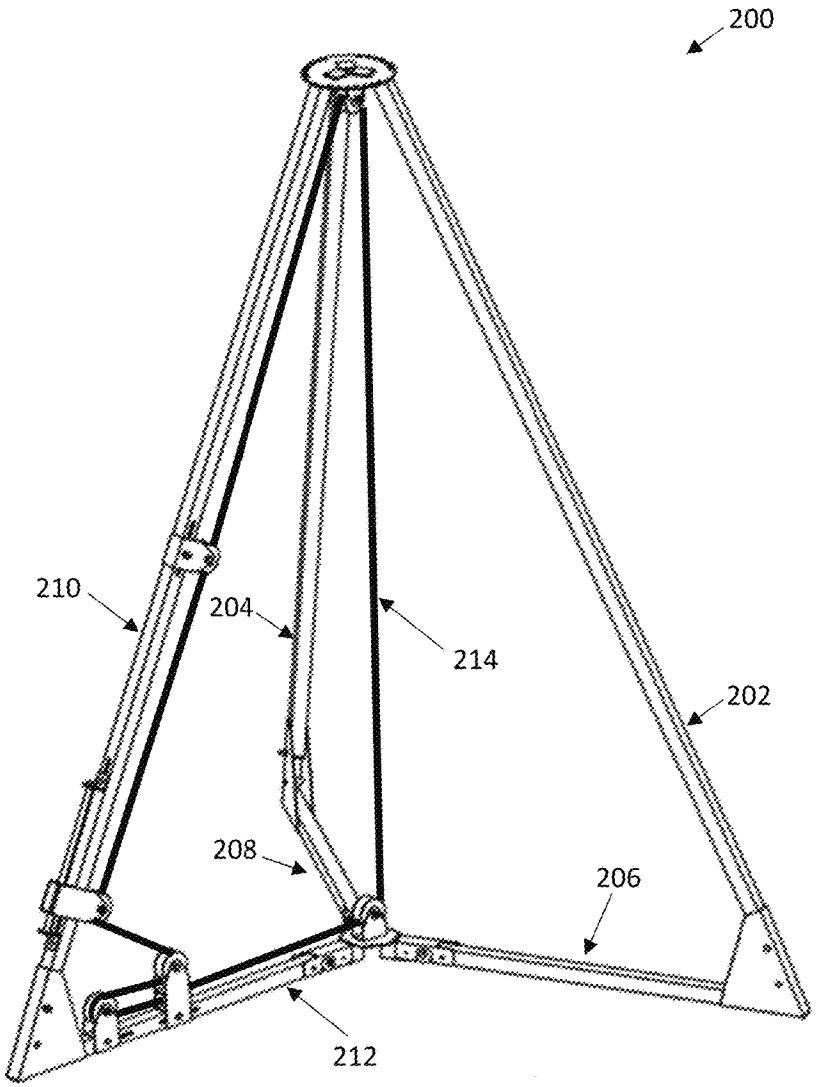
FIG. 2 illustrates an assembled serpentine climbing cord exercise climber.

FIG. 2 illustrates an assembled serpentine climbing cord exercise climber, now including the serpentine route of a climbing cord. In particular, assembled serpentine climbing cord exercise climber 200 may comprise a first lateral frame member 202 and a second lateral frame member 204 that are substantially identical. Correspondingly, a first bottom support member 206 may attach to a bottom end of first lateral frame member 202 and a second bottom support member 208 may connect to a bottom end of second lateral frame member 204 (first bottom support member 206 and second bottom support member 208 may be identical). A third lateral frame member 210 may have variations to accommodate one or more pulleys of a pulley system, where the pulley system may be for operation of clutch mechanism and tensioner pulley, in some embodiments. Further, as shown, a third bottom support member 212 may attach to a bottom end of third lateral frame member 210 and may also accommodate one or more pulleys of the pulley system. The pulley system is implemented so as to provide a serpentine path for a climbing cord 214, which as shown comprises a rope. Climbing cord 214 may be a closed loop that when engaged with a downward force (e.g., by an individual pulling down on the climbing cord 214), slides in a direction that it is being pulled along the pulley system (e.g., along central vertical axis 108).

Of note regarding the pulley system, the location and spacing of the pulleys of the pulley system may be varied to accommodate different weights and classes of users for cord exercise climber 200. From this, the pulleys may be fixed at such desired locations along third lateral frame member 210 and third bottom support member 212. In the example shown in FIG. 2, six pulleys make up the pulley system. The pulleys may preferably by fabricated by hand milling out of Delrin® resin. In addition, captures holding the pulleys may be attached using ½-inch grade 8 bolts or using another suitable fastening mechanism. In another embodiment, the pulley shells are preferably uniform in size and shape, except as noted below.

Furthermore, it is contemplated that a distance counter mechanism may be affixed along third lateral frame member 210 so as to measure a distance of climb cord "climbed" by an individual as they interact with serpentine climbing cord exercise climber 100. Such distance counter mechanism may be an electronic-based distance measurer or a mechanical cord length (e.g., wire/cable) counter.

Figure 3:
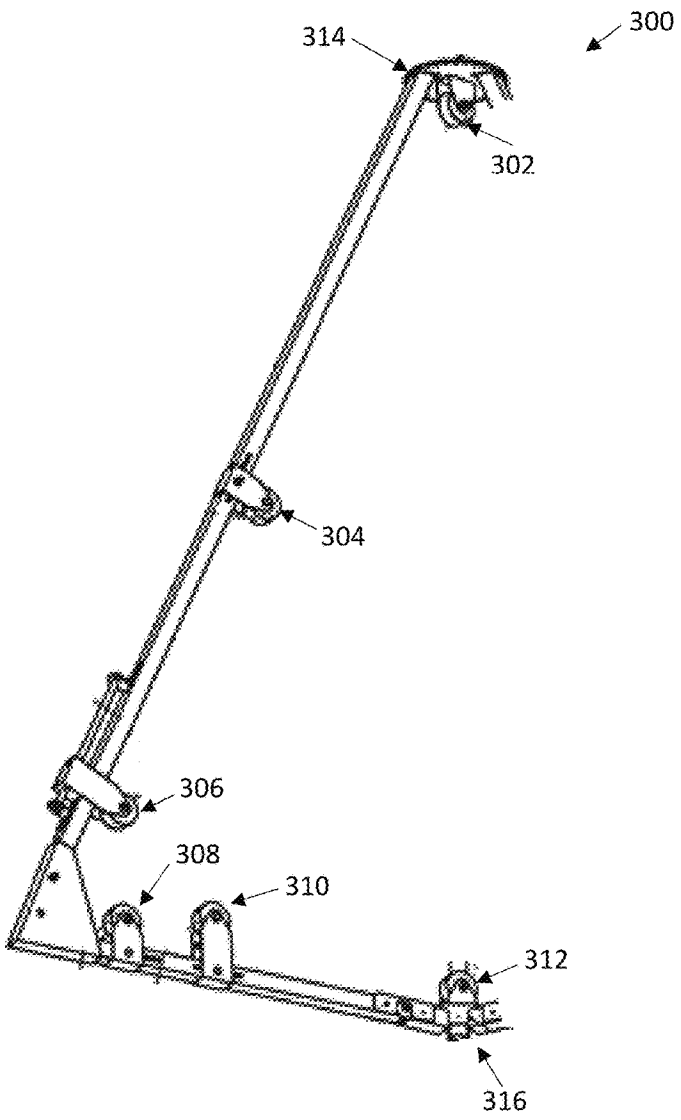
FIG. 3 illustrates an example pulley system of an example serpentine climbing cord exercise climber.

FIG. 3 illustrates an example pulley system of an example serpentine climbing cord exercise climber. As shown, pulley system 300 may comprise a first pulley 302, a second pulley 304, a third pulley 306, a fourth pulley 308, a fifth pulley 310, and a sixth pulley 312. First pulley 302 and sixth pulley 312 may be typical in size and/or shape, and they be attached respectively, to a central circular head plate 314 and central joiner 316 by either welding or a two-bolt pattern. Second pulley 304 and fourth pulley 308 may be typical in size and mounting. Fifth pulley 310 may include a welded spacer (or capture) and a taller profile to allow a climbing rope to run parallel to the adjacent bottom support after the rope is redirected. The pulleys may be of the same size (e.g., diameter) and third pulley 306 may include a traveler clutch mechanism. As will be understood to one having ordinary skill in the art, pulley system 300 may be operable with a climbing cord (e.g., a rope) so as to facilitate movement of the climbing cord along a serpentine path defined by the pulley system 300. That is, when the climbing cord is "climbed" by a person (notably, with feet of the person off the ground), the climbing cord may be understood as providing just enough movement so as to have the person stay in place, relative to example serpentine climbing cord exercise climber 100.

Figure 4A:
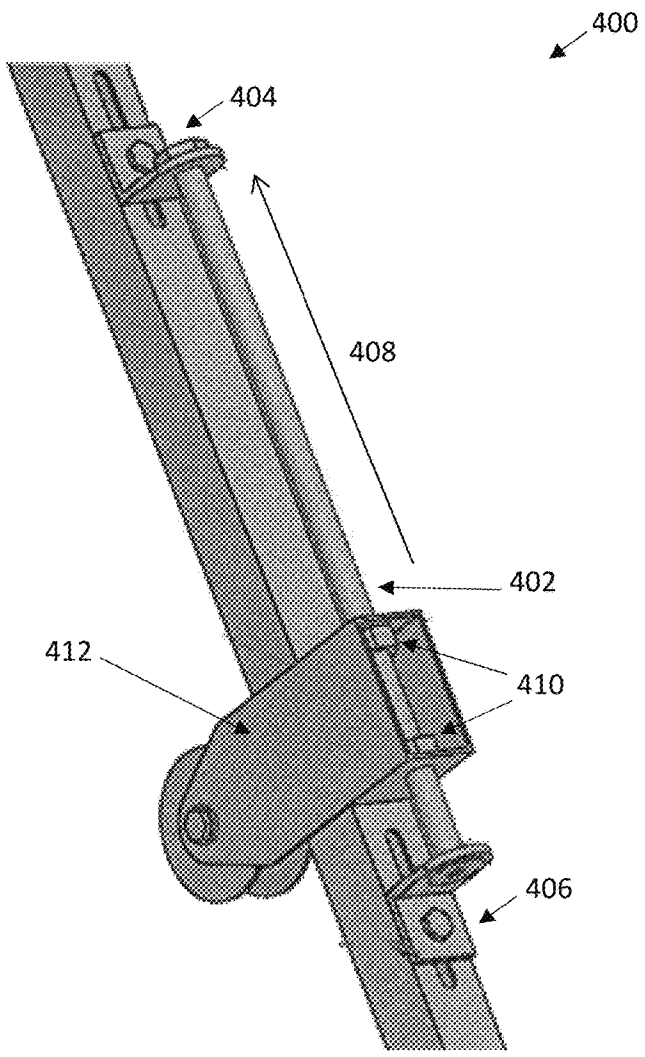
FIGS. 4A-4C illustrate an example clutch mechanism for pulley system of a serpentine climbing cord exercise climber.
Figure 4B:
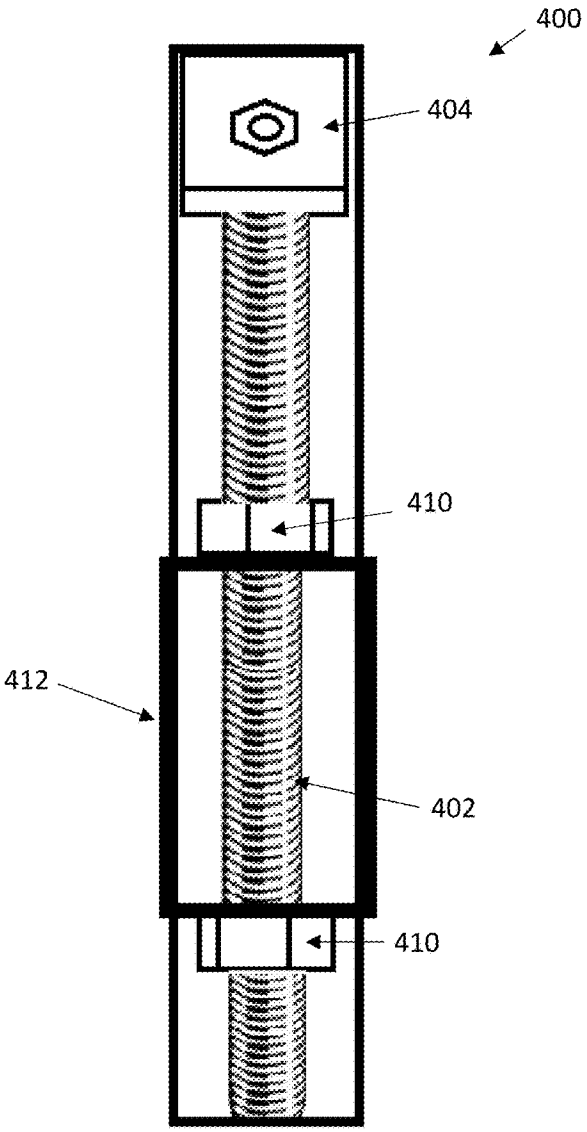
Figure 4C:
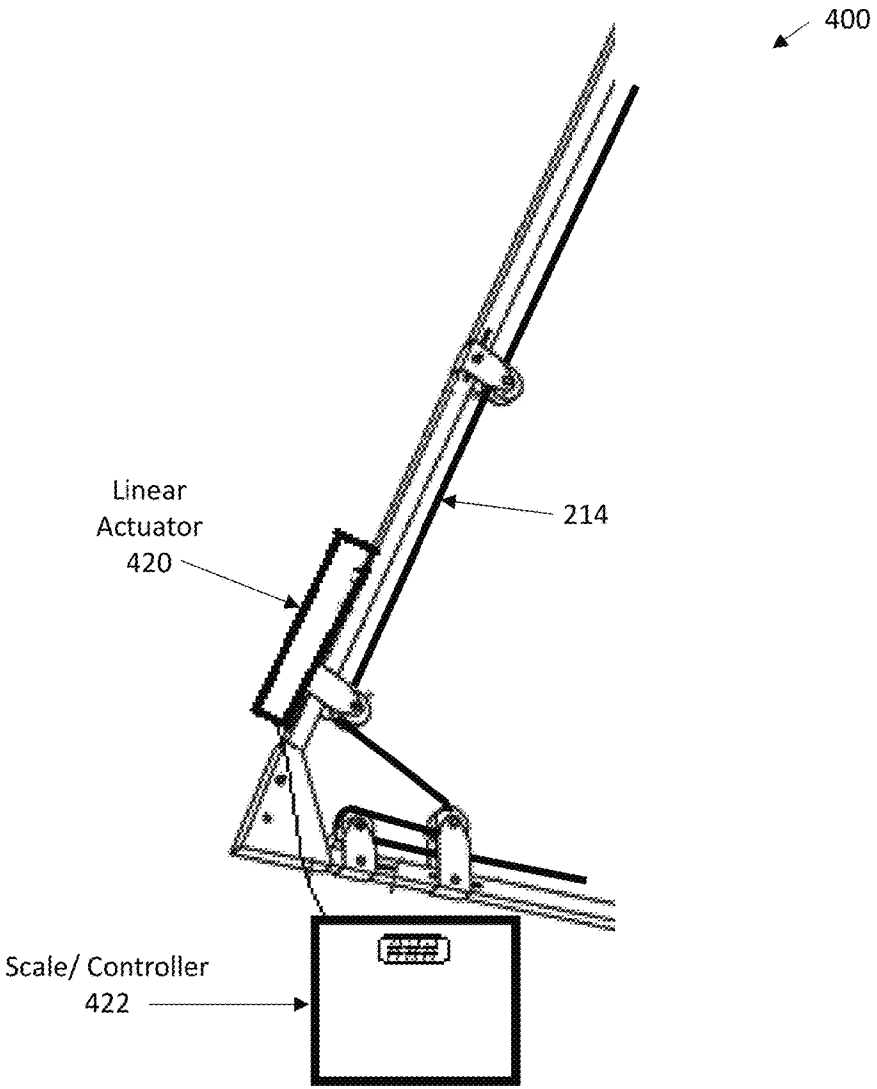

FIGS. 4A-4C illustrate an example clutch mechanism for a pulley system of a serpentine climbing cord exercise climber. An example clutch mechanism 400 is shown in FIG. 4A that may employ a long bolt 402 (or threaded rod) held by a first L-bracket 404 and second L-bracket 406 in a manner permitting rotation of the long bolt 402. As shown, turning the long bolt 402 in a clockwise manner, with the threads on the bolt engaging the nuts 410 welded to the base of the traveling pulley shell 412, results in the pulley moving in a direction 408 shown in FIG. 4A. Such pulley movement applies greater tension to a climbing cord of serpentine climbing cord exercise climber, increasing the force required to pull the rope through the pulley system. This manner of adjustment allows the use of the rope climber by a heavier individual. Reversing the direction of bolt rotation lessens rope tension, adjusting the rope climber for use by a lighter-weight person. In a preferred embodiment, a ¾-inch bolt or rod is used to trap third pulley 306, as shown in FIG. 3, and then captured by a pair of nuts welded onto first L-bracket 404 and second L-bracket 406. FIG. 4B illustrates a top down view of clutch mechanism 400, notably illustrating how nuts 410 may alternatively be welded to the outside of the traveling pulley shell 412.

FIG. 4C illustrates a view of clutch mechanism 400 as it engages climbing cord 214. Further, as shown in FIG. 4C, it is contemplated that clutch mechanism 400 may be is configured to operate in combination with a linear actuator mechanism 420 that automatically adjusts tension provided by clutch mechanism 400 in a fashion that corresponds to an individual's weight, such as may be determined by scale/controller 422 or otherwise input into a controller system. That is, linear actuator mechanism 420, after an individual's weight is measured by scale/controller 422, may be configured to auto-adjust tension on climbing cord 214 via clutch mechanism 400 (by moving the associated pully) so as to counterbalance the measured weight. Notably, linear actuator mechanism 420 may be configured to move in any appropriate manner and may also be configured to rotate and tighten or loosen long bolt 402 as in FIGS. 4A-4B above.

Figure 5C:
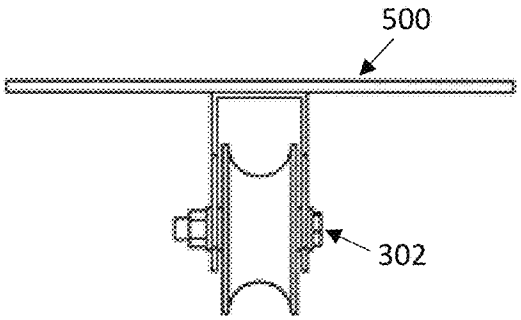
FIGS. 5A-5D illustrate an example head plate for a serpentine climbing cord exercise climber
Figure 5B:
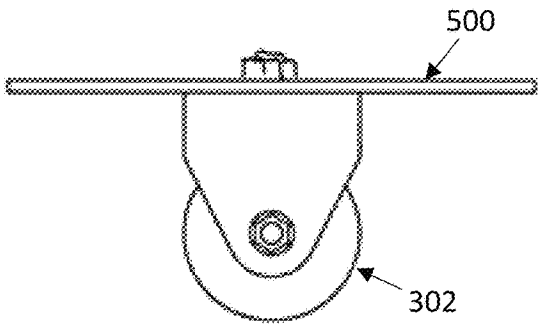
Figure 5A:
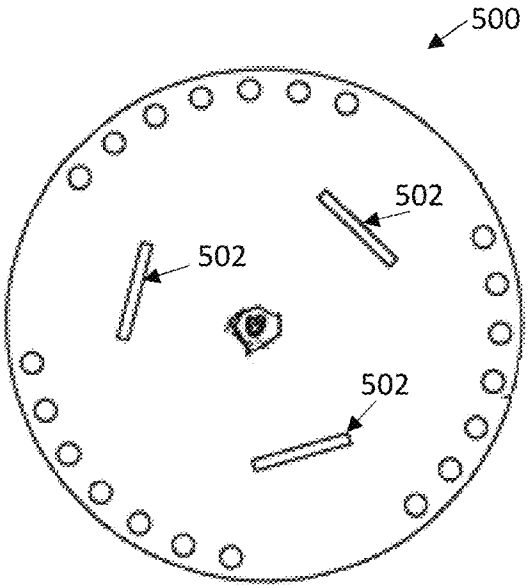

FIGS. 5A-5D illustrate an example head plate for a serpentine climbing cord exercise climber. In FIG. 5A, a top-down view of an example head plate 500 is shown, where head plate 500 comprises three slots 502 (or apertures) formed and located 120 degrees from one another, each for receiving a connecting hinge/tab, such as an S-shaped hinge, formed at the upper end of each lateral frame member (e.g., lateral frame members 102), allowing for foldability (collapsibility) of the entire structure by hinging the corresponding tabs within the three slots 502. Each slot may be cut or formed at an angle. Such angle correlates to the vertical angle of the lateral frame members (e.g., lateral frame members 102), which may be determined by the length of bottom supports of serpentine climbing cord exercise climber (e.g., bottom support members 106). In FIG. 5B, a side view of head plate 500 is shown, where first pulley 302 is shown affixed to a bottom portion of head plate 500. In FIG. 5C, another side view of head plate 500 is shown, where an aperture of first pulley 302 is shown where a climbing cord 214 may be inserted through the aperture (not shown).

Figure 5D:
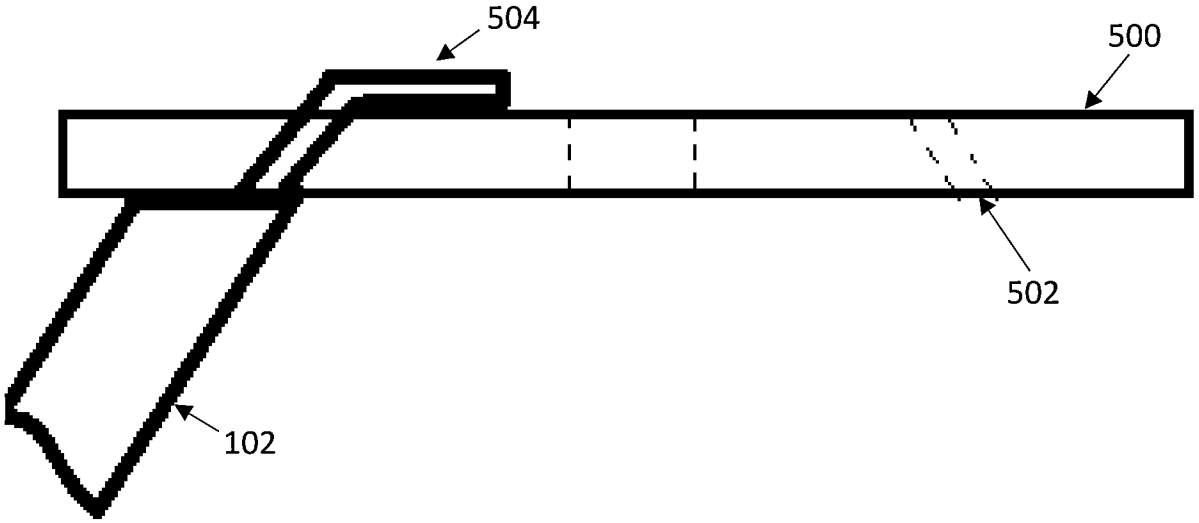

In FIG. 5D, one of the three slots 502 is shown at an appropriately-set angle, so as to allow it to receive a middle portion of the "S" hinge 504 in a manner that placing the top and bottom portions of the "S" in a horizontal orientation, matching the top and bottom surfaces of head plate 500 and a top surface of a lateral frame member (e.g., lateral frame members 102). As so oriented, the "S" hinge bears none of the static or dynamic loadings of, for example, serpentine climbing cord exercise climber 100.

Figure 6B:
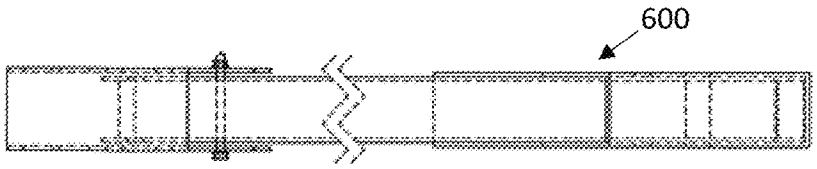
FIGS. 6A-6C illustrate an example envelope capture that connects a lateral frame member to a bottom support member of a serpentine climbing cord exercise climber.
Figure 6A:
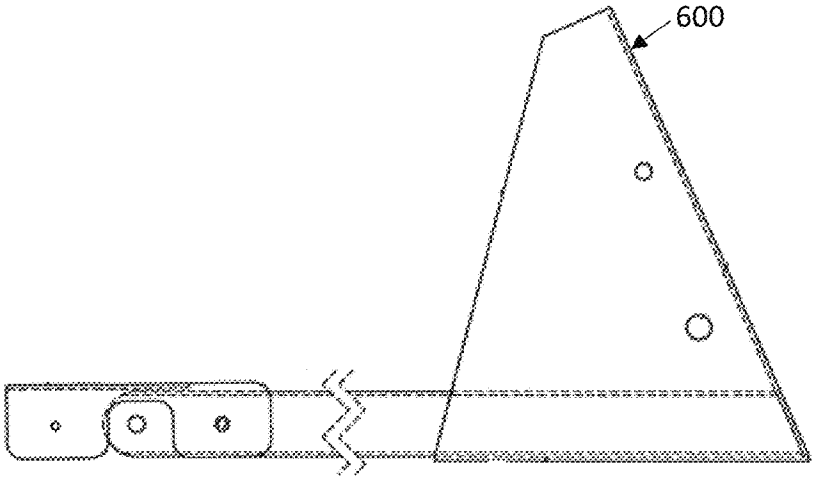
Figure 6C:
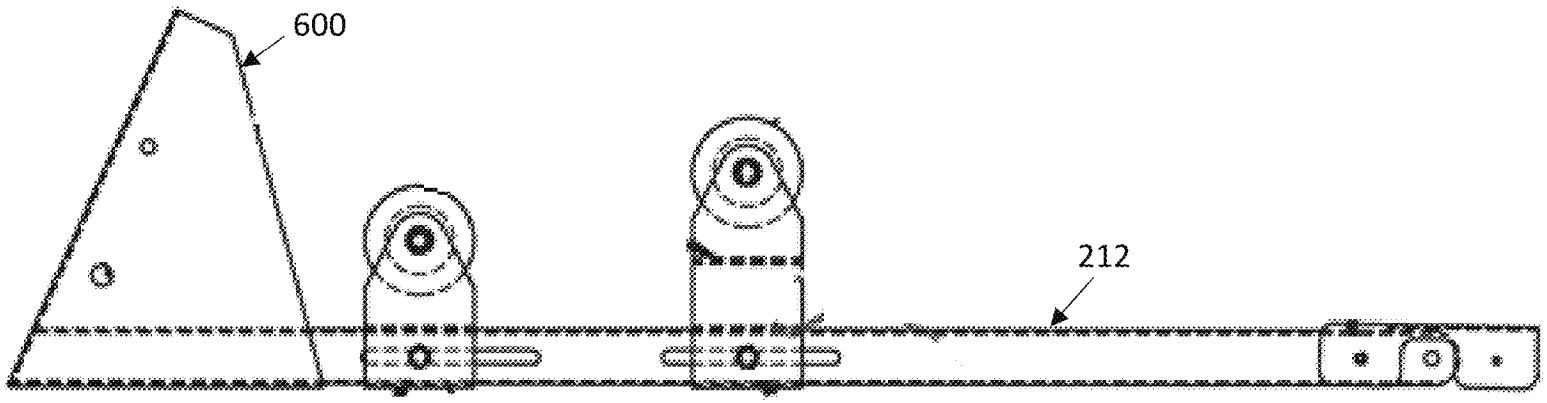

FIGS. 6A-6C illustrate an example envelope capture that connects a lateral frame member to a bottom support member of a serpentine climbing cord exercise climber. As shown in FIG. 6A, an example envelope capture 600 may be formed using a steel plate bent on a break press on one side and welded to the other side, creating the envelope, in some embodiments. FIG. 6B illustrates a top-down view of envelope capture 600. FIG. 6C illustrates envelope capture 600 with third bottom support member 212 inserted into it.

Figure 7A:
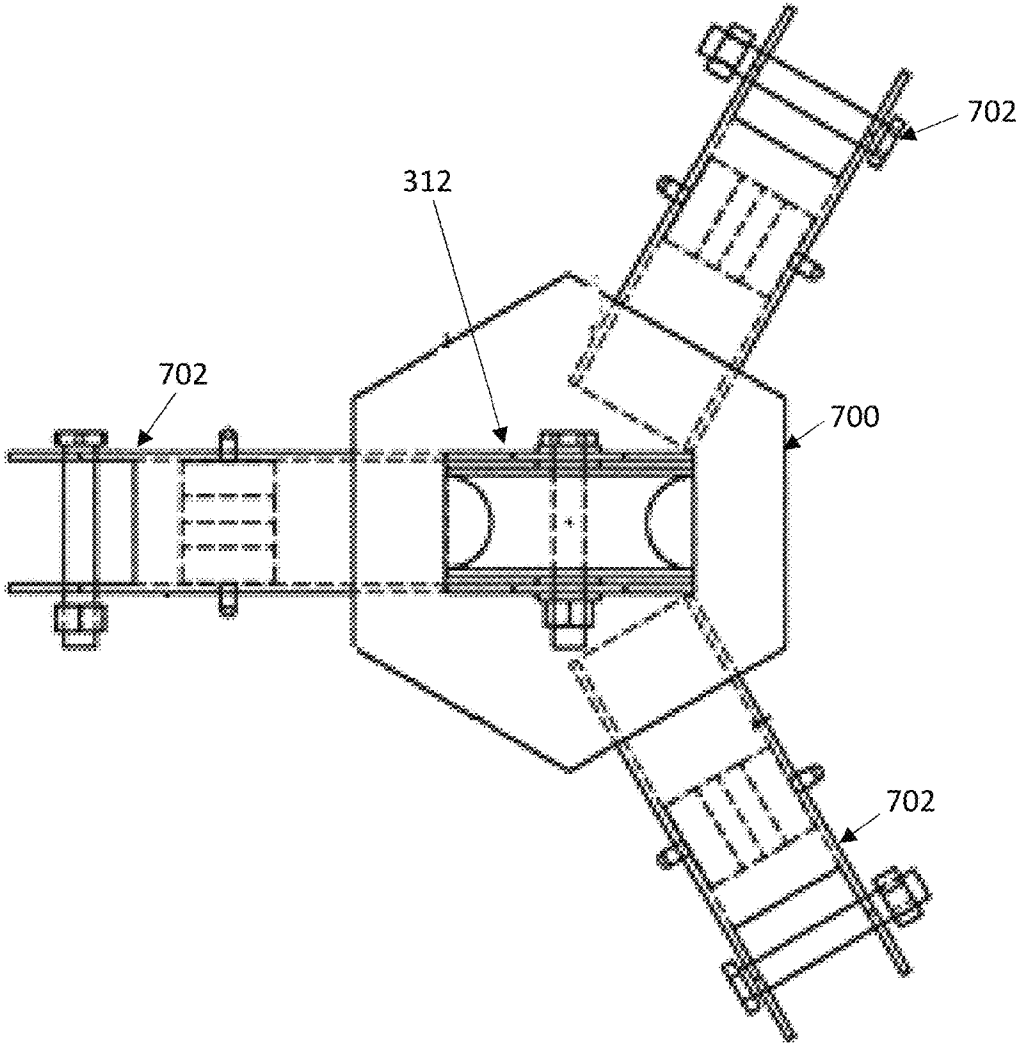
FIGS. 7A-7B illustrate an example central joiner that joins bottom support members of a serpentine climbing cord exercise climber.
Figure 7B:
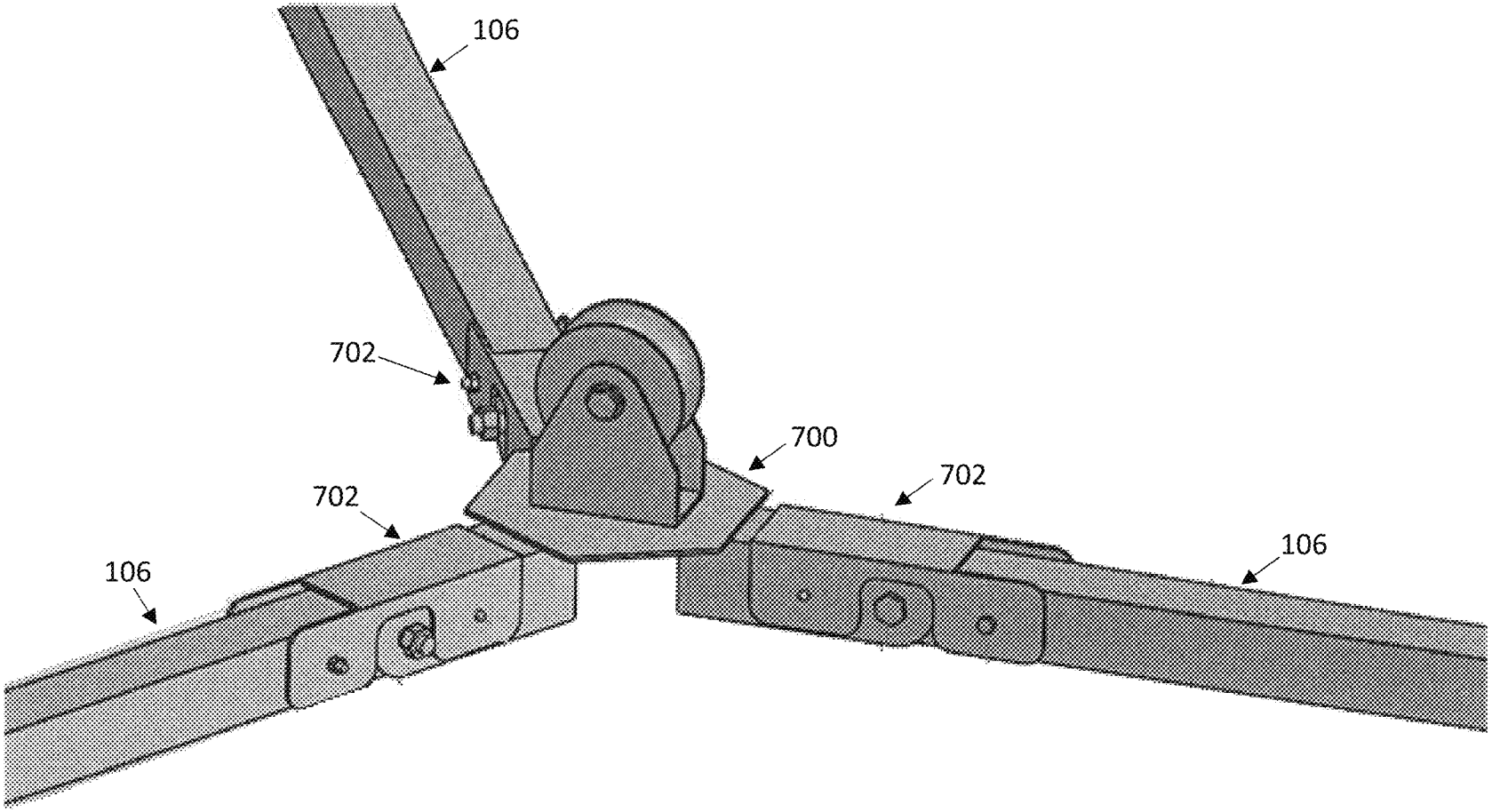

FIGS. 7A-7B illustrate an example central joiner that joins bottom support members of a serpentine climbing cord exercise climber. In FIG. 7A a central joiner 700 is shown as hexagonal connector plate located at the central axis (of serpentine climbing cord exercise climber 100) comprising connector tubes 702, extending from a bottom surface of central joiner 700, that allow connections with bottom support members 106. That is, bottom support members 106 may have its inward ends directed towards one-another, where ends of bottom support members 106 connect at a central vertical axis of central joiner 700. Connector tubes 702 may connect with ends of bottom support members 106 using a ½-inch grade 8 bolt to form a hinged connection. In addition, as shown, sixth pulley 312 may be affixed to a top portion of central joiner 700.

FIG. 7B illustrates how a locking member rotatably extends from ends of bottom support members 106, and releasably engages with connector tubes 702 of central joiner 700. When locking member is engaged in its down position, the bottom support and the connector tube remain linearly engaged, resisting upward movement that might otherwise occur because of tension forces generated during use of the rope climber and applied through the connection. On releasing the locking member, enabling it to rotate upward from its locked position, the hinged connection between the bottom support and the connector tube can rotate. Raising central joiner 700 may then facilitate folding in of lateral frame members 102 for transport and storage. Specifically, lateral frame members 102 are attached to central circular head plate 104 and to bottom support members 106 in such a fashion so as to allow serpentine climbing cord exercise climber 100 to close to a folded position while still assembled. A ½-inch bolt may be removed from each of the locking members. Lifting on central joiner 700 results in each of the bottom support members 106 pivoting upward, folding in the lateral frame members 102 in the manner of a tripod. In one or more embodiments, securement straps may be used to secure the folded climber for transport. Further, it is contemplated that optional pads may interlock with hook and loop fasteners (or other types of fastening mechanisms) to cover bottom support members 106 and other open areas.

Figure 8:
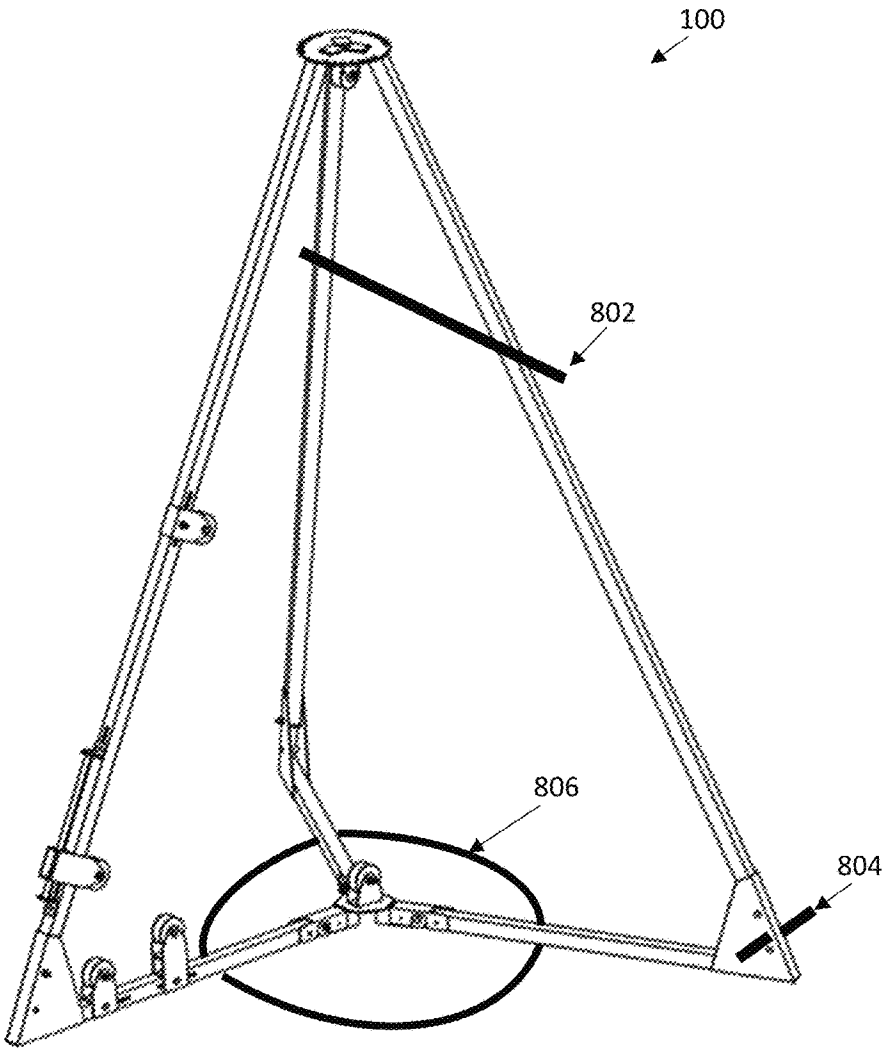
FIG. 8 illustrates example attachments that may be connected to a serpentine climbing cord exercise climber.

In various embodiments, additional exercise structures or attachments may be attached to the climbing frame. In particular, FIG. 8 illustrates example attachments that may be connected to serpentine climbing cord exercise climber 100. As shown, a pull-up bar attachment 802 may be removably affixed between two of lateral frame members 102 in a perpendicular fashion so as to allow an individual to perform pull-ups, chin-ups, and other forms of exercises that are enabled by having the bar attached to serpentine climbing cord exercise climber 100. Furthermore, it is contemplated that a sit-up exercise attachment 804 may be affixed to one or more envelope captures of serpentine climbing cord exercise climber 100, where sit-up exercise attachment 804 may assist an individual in performing sit-ups, or the like. In addition, serpentine climbing cord exercise climber 100 may comprise a reinforcement plate 806 (e.g., steel) that may be affixed, for example, to a bottom end of central joiner 114 so as to provide further support for serpentine climbing cord exercise climber 100 (e.g., as further structural rigidity support and/or as a counterweight).

In closing, an illustrative serpentine climbing cord exercise climber herein may comprise: a plurality of lateral frame members that are connected at upwardly extending ends with a head plate; a plurality of bottom support members that are each connected at outwardly extending ends to respective downwardly extending ends of the plurality of lateral frame members, wherein inwardly extending ends of the plurality of bottom support members are connected by a central joiner that is substantially aligned along a vertical axis with the head plate; and a pulley system comprising one or more pulleys that are coupled to one of the plurality of lateral frame members, one of the plurality of bottom support members, the head plate, and the central joiner, the pulley system is operable to allow a climbing cord to travel along the vertical axis and a path defined by the one or more pulleys.

In one embodiment, the pulley system further comprises a clutch mechanism operable to adjust tension on the climbing cord. In one embodiment, the clutch mechanism is manually adjustable to move a location of a particular pulley of the one or more pulleys to correspondingly adjust tension on the climbing cord. In one embodiment, the clutch mechanism comprises a controller configured to control a linear actuator to move a location of a particular pulley of the one or more pulleys to correspondingly adjust tension on the climbing cord. In one embodiment, the controller is configured to adjust tension on the climbing cord based on an input weight of a climber. In one embodiment, the climbing cord is a rope. In one embodiment, the serpentine climbing cord exercise climber is in substantially a pyramidal shape. In one embodiment, the serpentine climbing cord exercise climber is collapsible. In one embodiment, the serpentine climbing cord exercise climber further comprises a pull-up bar attachment. In one embodiment, the serpentine climbing cord exercise climber further comprises a sit-up attachment. In one embodiment, the serpentine climbing cord exercise climber further comprises a distance counter mechanism. In one embodiment, the plurality of lateral frame members and the plurality of bottom support members are substantially linear. In one embodiment, the serpentine climbing cord exercise climber further comprises a reinforcement plate.

Advantageously, the illustrative serpentine climbing cord exercise climber herein is compact, portable, collapsible, and does not require a large vertical space nor attachment to a ceiling or beam. In addition, the adjustable clutch tensioning pulley system herein allows for a climber to hang freely from the cord/rope along the vertical axis, without movement in the cord, until the climber adds sufficient force to "climb" the rope, at which time the rope is pulled downward along the vertical axis, and the climber remains substantially in the same location (i.e., within the framed space of the assembled exercise apparatus). By "fine-tuning" the tension set by adjusting the location of the clutch mechanism/pulley system, each individual user of a corresponding weight can is benefit from the climbing cord not simply "slipping" downward while not climbing with the climber's feet off the ground.

As will be appreciated, the above examples are intended only for the understanding of certain aspects of the techniques herein and are not limiting in nature. While the techniques are described primarily with respect to a particular device or system, the disclosed processes may be executed by other devices according to further implementations.

The foregoing description has been directed to specific embodiments. It will be apparent, however, that other variations and modifications may be made to the described embodiments, with the attainment of some or all of their advantages. Accordingly, this description is to be taken only by way of example and not to otherwise limit the scope of the embodiments herein. Therefore, it is the object of the appended claims to cover all such variations and modifications as come within the true spirit and scope of the embodiments herein.

What is claimed is:

1. A serpentine climbing cord exercise climber, comprising:

a plurality of lateral frame members that are connected at upwardly extending ends with a head plate;

a plurality of bottom support members that are each connected at outwardly extending ends to respective downwardly extending ends of the plurality of lateral frame members, wherein inwardly extending ends of the plurality of bottom support members are connected by a central joiner that is substantially aligned along a vertical axis with the head plate; and a pulley system comprising one or more pulleys that are coupled to one of the plurality of lateral frame members, one of the plurality of bottom support members, the head plate, and the central joiner, the pulley system operable to allow a climbing cord to travel along the vertical axis and a path defined by the one or more pulleys.

2. The serpentine climbing cord exercise climber as in claim 1, wherein the pulley system further comprises a clutch mechanism operable to adjust tension on the climbing cord.

3. The serpentine climbing cord exercise climber as in claim 2, wherein the clutch mechanism is manually adjustable to move a location of a particular pulley of the one or more pulleys to correspondingly adjust tension on the climbing cord.

4. The serpentine climbing cord exercise climber as in claim 2, wherein the clutch mechanism comprises a controller configured to control a linear actuator to move a location of a particular pulley of the one or more pulleys to correspondingly adjust tension on the climbing cord.

5. The serpentine climbing cord exercise climber as in claim 4, wherein the controller is configured to adjust tension on the climbing cord based on an input weight of a climber.

6. The serpentine climbing cord exercise climber as in claim 1, wherein the climbing cord is a rope.

7. The serpentine climbing cord exercise climber as in claim 1, wherein the serpentine climbing cord exercise climber is in substantially a pyramidal shape.

8. The serpentine climbing cord exercise climber as in claim 1, wherein the serpentine climbing cord exercise climber is collapsible.

9. The serpentine climbing cord exercise climber as in claim 1, further comprising a pull-up bar attachment.

10. The serpentine climbing cord exercise climber as in claim 1, further comprising a sit-up attachment.

11. The serpentine climbing cord exercise climber as in claim 1, further comprising a distance counter mechanism.

12. The serpentine climbing cord exercise climber as in claim 1, wherein the plurality of lateral frame members and the plurality of bottom support members are substantially linear.

13. The serpentine climbing cord exercise climber as in claim 1, further comprising a reinforcement plate.

* * * * *